US005516628A

United States Patent [19]

Parton et al.

[11] Patent Number: 5,516,628

[45] Date of Patent: May 14, 1996

[54] SILVER HALIDE PHOTOGRAPHIC ELEMENTS WITH PARTICULAR BLUE SENSITIZATION

[75] Inventors: Richard L. Parton; David A. Stegman; Kevin W. Williams; Vishwakarma L. Chand, all of Rochester, N.Y.

[73] Assignee: Eastman Kodak Company, Rochester, N.Y.

[21] Appl. No.: 429,370

[22] Filed: Apr. 26, 1995

[51] Int. Cl.[6] ..... G03C 1/16

[52] U.S. Cl. ..... 430/583; 430/567; 430/581; 430/587

[58] Field of Search ..... 430/583, 567, 430/582, 581, 587

[56] References Cited

U.S. PATENT DOCUMENTS

| | | | |
|---|---|---|---|
| 4,689,292 | 8/1987 | Metoki et al. | 430/567 |
| 4,725,532 | 2/1988 | Kameoka et al. | 430/566 |
| 4,741,995 | 5/1988 | Tani et al. | 430/558 |
| 4,751,174 | 6/1988 | Toya | 430/502 |
| 4,830,958 | 5/1989 | Okumura et al. | 430/567 |
| 4,942,121 | 7/1990 | Kajiwara et al. | 430/583 |
| 4,945,038 | 7/1990 | Momoki et al. | 430/576 |
| 5,082,765 | 1/1992 | Onodera et al. | 430/377 |
| 5,418,126 | 5/1995 | Stegman et al. | 430/583 |

FOREIGN PATENT DOCUMENTS

| | | |
|---|---|---|
| 62-178947 | 8/1987 | Japan . |
| 02096149 | 4/1990 | Japan . |
| 03141345 | 6/1991 | Japan . |
| 03288847 | 12/1991 | Japan . |

*Primary Examiner*—Thorl Chea

*Attorney, Agent, or Firm*—Gordon M. Stewart; Edith A. Rice

[57] ABSTRACT

A photographic element with a silver halide emulsion having a maximum sensitivity in the visible region at less than 480 nm and being sensitized by a dye of formula (I):

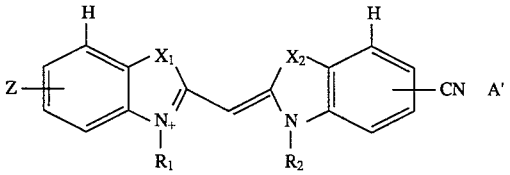

(I)

wherein: $X_1$ and $X_2$ each independently represent S, Se or O; $R_1$ and $R_2$ are, independently, an alkyl group; Z represents an aromatic group or heteroaromatic group that is directly appended to the benzene ring shown or is attached through a linking group provided that the atoms of the linking group are $sp^2$ hybridized, or Z can be a fused aromatic ring group; the benzene rings shown can be further substituted or unsubstituted, and; A' is one or more ions as needed to balance the charge on the molecule.

13 Claims, No Drawings

SILVER HALIDE PHOTOGRAPHIC ELEMENTS WITH PARTICULAR BLUE SENSITIZATION

FIELD OF THE INVENTION

This invention relates to photographic elements having silver halide emulsions which are blue sensitized with particular blue sensitizing dyes.

BACKGROUND OF THE INVENTION

Most modern color photographic printing papers employ silver halide emulsions having a high chloride content in order to obtain rapid processing rates relative to silver bromide emulsions. The composition of these silver halide emulsions is usually AgClBr, where the percentage of bromide is very low, typically around 0.5% to 5%, and usually about 1%. The presence of small proportions of bromide enhances photoefficiency of the silver chloride emulsions and enhances the adsorption of sensitizing dyes to the emulsion surface while still allowing for rapid processing. However, even with small amounts of bromide present, some sensitizing dyes do not adsorb well to these emulsions resulting in poor spectral sensitization. Also, some dyes are very sensitive to the bromide level. A high level of bromide sensitivity is undesirable because it can lead to variability during the color paper manufacturing process.

Color printing papers usually consist of at least three emulsions that are sensitized to blue, green and red light. Proper sensitization can be achieved by employing an appropriate sensitizing dye in each layer. Many common color photographic printing papers have a blue layer which is sensitized with a sensitizing dye so as to have a maximum sensitivity in the visible region at about 480 nm.

Color photographic printing paper is intended to generate a print from a photographic color negative. An important quality characteristic of color paper is color reproduction which is the ability to accurately portray the colors, or, more precisely, the hues of the original scene. Replacing a deep blue sensitizing dye which might sensitize at 480 nm or longer, with a dye that sensitizes at a shorter wavelength, can provide a color paper with improved color reproduction. For example, this can be attained by replacing a dye such as dye C-1 described below, which provides an emulsion with a maximum sensitivity in the visible region ("λsens") at 480 nm, with a dye that sensitizes at 470 run or shorter.

However, using a shorter blue sensitizing dye typically results in a speed loss with normal printer exposures. One reason for this is that the energy output of the exposing device in many color paper printers diminishes at wavelengths shorter than 480 nm.

A cyano substituted sensitizing dye (comparative dye C-2 described below) has been disclosed in U.S. Pat. No. 4,942,121; 5,082,765 and 4,840,958. However, such a dye does not provides an emulsion with good sensitivity.

It would be desirable then, to provide sensitizing dyes that can provide a silver halide emulsion with a maximum visible light sensitivity at shorter than 480 nm, and preferably at 470 nm or shorter, which still provides the emulsion with good speed. Additionally, it would be desirable that the performance of such a dye does not vary too much with small changes in bromide levels in the silver halide emulsion.

SUMMARY OF THE INVENTION

Accordingly, the present invention provides a photographic element comprising a silver halide emulsion having a maximum sensitivity in the visible region at less than 480 nm and being sensitized by a dye of formula (I):

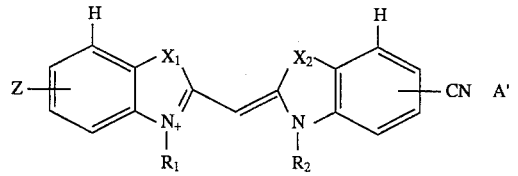

(I)

wherein: $X_1$ and $X_2$ each independently represent S, Se or O; $R_1$ and $R_2$ are, independently, an alkyl group; Z represents an aromatic group or heteroaromatic group that is directly appended to the benzene ring shown or is attached through a linking group provided that the atoms of the linking group are $sp^2$ hybridized, or Z can be a fused aromatic ring; the benzene rings shown can be further substituted or unsubstituted, and; A' is one or more ions as needed to balance the charge on the molecule.

The blue sensitized silver halide emulsions of photographic elements of the present invention have a maximum visible light sensitivity at shorter than 480 nm, while still having good sensitivity. Additionally, the sensitivity of such blue sensitized silver halide emulsions does not vary too much with small changes in bromide levels in the silver halide emulsion.

EMBODIMENTS OF THE INVENTION

In the present application, reference to "under", "above", "below", "upper", "lower" or the like terms in relation to layer structure of a photographic element, is meant the relative position in relation to light when the element is exposed in a normal manner. "Above" or "upper" would mean closer to the light source when the element is exposed normally, while "below" or "lower" would mean further from the light source. Since a typical photographic element has the various layers coated on a support, "above" or "upper" would mean further from the support, while "below" or "under" would mean closer to the support.

Further, in the present application, the term "aromatic" refers to aromatic rings as described in J. March, *Advanced Organic Chemistry,* Chapter 2 (1985, publisher John Wiley & Sons, New York, N.Y.). Reference in this application to any chemical "group" (such as alkyl group, aryl group, heteroaryl group, and the like) includes the possibility of it being both substituted or unsubstituted (for example, alkyl group and aryl group include substituted and unsubstituted alkyl and substituted and unsubstituted aryl, respectively). Generally, unless otherwise specifically stated, substituent groups usable on molecules herein include any groups, whether substituted or unsubstituted, which do not destroy properties necessary for the photographic utility. It will also be understood throughout this application that reference to a compound of a particular general formula includes those compounds of other more specific formula which specific formula falls within the general formula definition.

By "visible region" in reference to a region of the light spectrum, is meant 400–700 nm. The emulsion is preferably sensitized so as to have a maximum sensitivity in the visible region at less than or equal to 475 nm (although the dye could be selected to sensitize the emulsion with such a maximum sensitivity that is even less than or equal to 470 nm). Typically, the maximum sensitization of the emulsion, whether it be less than 480, 475 or 470 nm, is attained by sensitization with a dye of formula (I) only. However, it will be appreciated that while dyes of formula (I) can provide the desired maximum sensitization, they can be used in combination with other dyes providing the emulsion has a maximum sensitivity meeting the foregoing limitations.

It will be appreciated in formula (I) that while, following the usual convention, H atoms are not normally shown, they are shown in the 7-position on the two benzene rings. This is to show that those positions must be H, and particularly they cannot be substituted by —Z or —CN. In formula (I) above, preferably $X_1$ and $X_2$ are not both O, and further preferably both are S. In the case where $X_1$ and $X_2$ are both S, then the dye is of formula (Ia) below:

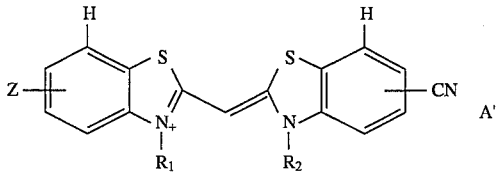

(Ia)

Preferably, $R_1$ and $R_2$ are both alky groups, for example both may be 1–8 (or 1 to 4) carbon alkyl groups, and may be the same or different. At least one of $R_1$ or $R_2$ is preferably substituted by an acid or acid salt group, although both $R_1$ and $R_2$ may be substituted by an acid or acid salt group.

As to the acid or acid salt groups described above, such groups include carboxy, sulfo, phosphato, phosphono, sulfonamido, sulfamoyl, or acylsulfonamido (groups such as —$CH_2$—CO—NH—$SO_2$—$CH_3$) groups. Note that reference to acid or acid salt groups are used to define only the free acid groups or their corresponding salts, and do not include esters where there is no ionizable or ionized proton. Particularly preferred are the carboxy and sulfo groups (for example, 3-sulfobutyl, 4-sulfobutyl, 3-sulfopropyl, 2-sulfoethyl, carboxymethyl, carboxyethyl, carboxypropyl and the like).

As already mentioned, Z represents an aromatic group or heteroaromatic group that is directly appended to the benzene ring shown or is attached through a linking group provided that the atoms of the linking group are $sp^2$ hybridized, or Z can be a fused aromatic ring (for example, a 4,5-benzene ring). As to $sp^2$ hybridization, this is described in *Advanced Organic Chemistry* 3rd Ed., J. March, (John Wiley Sons, N.Y.; 1985)). Such suitable linking groups include an akenyl linking group or an amide linking group. Examples of Z include a phenyl group or a pyrrolo group, furyl group or thiophene group, such as shown below:

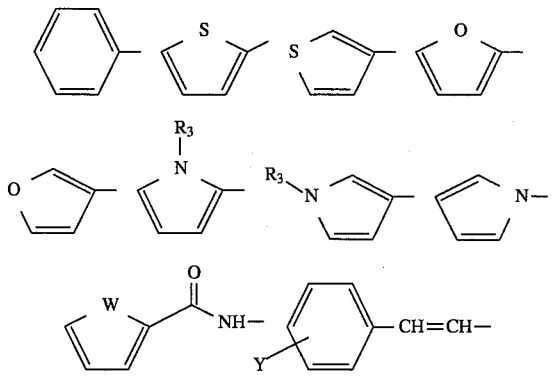

where $R_3$ is hydrogen, an alkyl group (for example, methyl, ethyl or 2-hydroxyethyl), or an aryl group (for example, phenyl or 4-hydroxyphenyl), and W can be N-R3, O, S; Y is alkyl, alkyloxy, or halogen.

Since $R_1$ and $R_2$ are preferably both substituted by an acid or acid salt group, A' will typically be a cation. Examples of suitable cations include sodium, potassium and triethylammonium.

The sensitizing dye of formula (I) is preferably of formula (Ib) below:

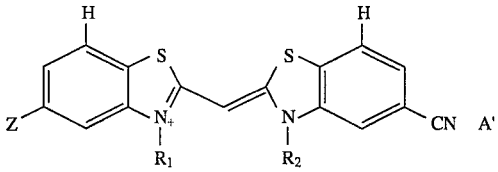

(Ib)

It will be understood that in formula (Ib) the benzene rings shown do not have any further substituents.

As already mentioned, the benzene rings shown in formula (I) may each be further substituted or not further subsituted. For example, either may have 0, 1 or 2 further substituents. Substituents may, for example, independently be, 1 to 18 carbon alkyl (or 1 to 6, or 1 to 2 carbon alkyl), aryl (such as 6 to 20 carbon atoms), heteroaryl (such as pyrrolo, furyl or thienyl), aryloxy (such as 6 to 20 carbon atoms) alkoxy (such as 1 to 6 or 1 to 2 carbon alkoxy), cyano, or halogen (for example F or Cl). Such substituents on the benzene rings can also include a ring fused thereto, such as a benzo, pyrrolo, furyl or thienyl ring. However, as shown in formula (I) and discussed previously, the benzene ring 7-position is unsubstituted (that is, it must be H) and therefore formula (I) excludes a 6,7- fused benzene ring substituent. Any of the alkyl and alkoxy substituents may have from 1 to 5 (or 1 to 2) intervening oxygen, sulfur or nitrogen atoms.

Substituents on any of the specified substituent groups defined above (including any of those substituents described for Z), can include halogen (for example, chloro, fluoro, bromo), alkoxy (particularly 1 to 10 carbon atoms; for example, methoxy, ethoxy), substituted or unsubstituted alkyl (particularly of 1 to 10 carbon atoms, for example, methyl, trifluoromethyl), amido or carbamoyl (particularly of 1 to 10 or 1 to 6 carbon atoms), alkoxycarbonyl (particularly of 1 to 10 or 1 to 6 carbon atoms), and other known substituents, and substituted and unsubstituted aryl ((particularly of 1 to 10 or 1 to 6 carbon atoms) for example, phenyl, 5-chlorophenyl), thioalkyl (for example, methylthio or ethylthio), hydroxy or alkenyl (particularly of 1 to 10 or 1 to 6 carbon atoms) and others known in the art. Additionally, any of the substituents may optionally be non-aromatic.

Examples of Formula I compounds used in photographic elements of the present invention are listed below in Table I:

TABLE I

Invention Dyes

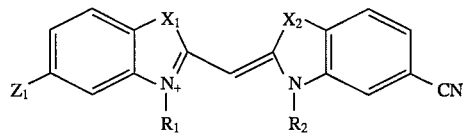

| Dye | $X_1$ | $X_2$ | $Z_1$ | $R_1$, $R_2$[a] |
|---|---|---|---|---|
| I-1 | S | S | phenyl | SP, SP |

TABLE I-continued

Invention Dyes

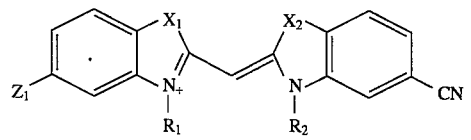

| Dye | $X_1$ | $X_2$ | $Z_1$ | $R_1$, $R_2$[a] |
|---|---|---|---|---|
| I-2 | S | S | S | 3SBu, SP |
| I-3 | S | S | O | SP, SP |
| I-4 | S | S | N— | " |
| I-5 | S | S | 4,5-benzo | " |
| I-6 | S | S | H N | " |
| I-7 | S | S | —CH=CH— | " |
| I-8 | S | S | H N O NH— | " |

[a]SP is 3-sulfopropyl, 3SBu is 3-sulfobutyl

Dyes of Formula I can be prepared according to techniques that are well-known in the art, such as described in Hamer, *Cyanine Dyes and Related Compounds,* 1964 (publisher John Wiley & Sons, New York, N.Y.) and T. H. James, editor, *The Theory of the Photographic Process,* 4th Edition, Macmillan, New York, 1977. The synthesis of dyes with furan and pyrrole nuclei are described in European Application Number 93203192.5. The synthesis of amide substituted dyes is described in European Application Number 92303190.9.

The amount of sensitizing dye that is useful to sensitize a silver halide emulsion in the photographic elements of the present invention, will typically be from 0.001 to 4 millimoles per mole of silver halide, but is preferably in the range of 0.01 to 1.0 millimoles per mole of silver halide. Optimum dye concentrations can be determined by methods known in the art.

Photographic elements of the present invention can be black and white elements, single color elements or multicolor elements. Multicolor elements contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like. All of these can be coated on a support which can be transparent or reflective (for example, a paper support). Photographic elements of the present invention may also usefully include a magnetic recording material as described in *Research Disclosure,* Item 34390, November 1992, or a transparent magnetic recording layer such as a layer containing magnetic particles on the underside of a transparent support as in U.S. Pat. No. 4,279,945 and U.S. Pat. No. 4,302,523. The element typically will have a total thickness (excluding the support) of from 5 to 30 microns. While the order of the color sensitive layers can be varied, they will normally be red-sensitive, green-sensitive and blue-sensitive, in that order on a transparent support, (that is, blue sensitive furthest from the support) and the reverse order on a reflective support being typical.

The present invention also contemplates the use of photographic elements of the present invention in what are often referred to as single use cameras (or "film with lens" units). These cameras are sold with film preloaded in them and the entire camera is returned to a processor with the exposed film remaining inside the camera. Such cameras may have glass or plastic lenses through which the photographic element is exposed.

In the following discussion of suitable materials for use in elements of this invention, reference will be made to *Research Disclosure,* September 1994, Number 365, Item 36544, identified hereafter by the term "Research Disclosure I." The Sections hereafter referred to are Sections of the Research Disclosure I unless otherwise indicated. All Research Disclosures referenced herein are published by Kenneth Mason Publications, Ltd., Dudley Annex, 12a North Street, Emsworth, Hampshire P010 7DQ, ENGLAND.

The silver halide emulsions employed in the photographic elements may be negative-working, such as surface-sensitive emulsions or unfogged internal latent image forming emulsions, or positive working emulsions of internal latent image forming emulsions (that are either fogged in the element or fogged during processing). Suitable emulsions and their preparation as well as methods of chemical and spectral sensitization are described in Sections I through V. Color materials and development modifiers are described in Sections V through XX. Vehicles which can be used in the photographic elements are described in Section II, and various additives such as brighteners, antifoggants, stabilizers, light absorbing and scattering materials, hardeners, coating aids, plasticizers, lubricants and matting agents are described, for example, in Sections VI through XIII. Manufacturing methods are described in all of the sections, layer arrangements particularly in in Section XI, exposure alternatives in Section XVI, and processing methods and agents in Sections XIX and XX.

With negative working silver halide a negative image can be formed. Optionally a positive (or reversal) image can be formed although a negative image is typically first formed.

The photographic elements of the present invention may also use colored couplers (e.g. to adjust levels of interlayer correction) and masking couplers such as those described in EP 213 490; Japanese Published Application 58-172,647; U.S. Pat. No. 2,983,608; German Application DE 2,706, 117C; U.K. Patent 1,530,272; Japanese Application A-113935; U.S. Pat. No. 4,070,191 and German Application DE 2,643,965. The masking couplers may be shifted or blocked.

The photographic elements may also contain materials that accelerate or otherwise modify the processing steps of bleaching or fixing to improve the quality of the image. Bleach accelerators described in EP 193 389; EP 301 477; U.S. Pat. No. 4,163,669; U.S. Pat. No. 4,865,956; and U.S. Pat. No. 4,923,784 are particularly useful. Also contemplated is the use of nucleating agents, development accelerators or their precursors (UK Patent 2,097,140; U.K. Patent 2,131,188); electron transfer agents (U.S. 4,859,578; U.S. 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The elements may also contain filter dye layers comprising colloidal silver sol or yellow and/or magenta filter dyes and/or antihalation dyes (particularly in an undercoat beneath all light sensitive layers or in the side of the support opposite that on which all light sensitive layers are located) either as oil-in-water dispersions, latex dispersions or as solid particle dispersions. Additionally, they may be used with "smearing" couplers (e.g. as described in U.S. Pat. No. 4,366,237; EP 096 570; U.S. Pat. No. 4,420,556; and U.S. Pat. No. 4,543,323.) Also, the couplers may be blocked or coated in protected form as described, for example, in Japanese Application 61/258,249 or U.S. Pat. No. 5,019, 492.

The photographic elements may further contain other image-modifying compounds such as "Developer Inhibitor-Releasing" compounds (DIR's). Useful additional DIR's for elements of the present invention, are known in the art and examples are described in U.S. Pat. Nos. 3,137,578; 3,148, 022; 3,148,062; 3,227,554; 3,384,657; 3,379,529; 3,615, 506; 3,617,291; 3,620,746; 3,701,783; 3,733,201; 4,049, 455; 4,095,984; 4,126,459; 4,149,886; 4,150,228; 4,211, 562; 4,248,962; 4,259,437; 4,362,878; 4,409,323; 4,477, 563; 4,782,012; 4,962,018; 4,500,634; 4,579,816; 4,607, 004; 4,618,571; 4,678,739; 4,746,600; 4,746,601; 4,791, 049; 4,857,447; 4,865,959; 4,880,342; 4,886,736; 4,937, 179; 4,946,767; 4,948,716; 4,952,485; 4,956,269; 4,959, 299; 4,966,835; 4,985,336 as well as in patent publications GB 1,560,240; GB 2,007,662; GB 2,032,914; GB 2,099, 167; DE 2,842,063, DE 2,937,127; DE 3,636,824; DE 3,644,416 as well as the following European Patent Publications: 272,573; 335,319; 336,411; 346, 899; 362, 870; 365,252; 365,346; 373,382; 376,212; 377,463; 378,236; 384,670; 396,486; 401,612; 401,613.

DIR compounds are also disclosed in "Developer-Inhibitor-Releasing (DIR) Couplers for Color Photography," C. R. Barr, J. R. Thirtle and P. W. Vittum in *Photographic Science and Engineering,* Vol. 13, p. 174 (1969), incorporated herein by reference.

It is also contemplated that the concepts of the present invention may be employed to obtain reflection color prints as described in *Research Disclosure,* November 1979, Item 18716, available from Kenneth Mason Publications, Ltd, Dudley Annex, 12a North Street, Emsworth, Hampshire P0101 7DQ, England, incorporated herein by reference. The emulsions and materials to form elements of the pres ent invention, may be coated on pH adjusted support as described in U.S. Pat. No. 4,917,994; with epoxy solvents (EP 0 164 961); with additional stabilizers (as described, for example, in U.S. Pat. No. 4,346,165; U.S. Pat. No. 4,540, 653 and U.S. Pat. No. 4,906,559); with ballasted chelating agents such as those in U.S. Pat. No. 4,994,359 to reduce sensitivity to polyvalent cations such as calcium; and with stain reducing compounds such as described in U.S. Pat. No. 5,068,171 and U.S. Pat. No. 5,096,805. Other compounds useful in the elements of the invention are disclosed in Japanese Published Applications 83- 09,959; 83-62,586; 90-072,629, 90-072,630; 90-072,632; 90-072,633; 90-072, 634; 90-077,822; 90-078,229; 90- 078,230; 90-079,336; 90-079,338; 90-079,690; 90- 079,691; 90-080,487; 90-080, 489; 90-080,490; 90- 0 080,491; 90-080,492; 90-080,494; 90-085,928; 90- 086,669; 90-086,670; 90-087,361; 90-087, 362; 90- 087,363; 90-087,364; 90-088,096; 90-088,097; 90-093,662; 90-093,663; 90-093,664; 90-093,665; 90- 093,666; 90-093,668; 90-094,055; 90-094,056; 90- 5 101,937; 90-103,409; 90-151,577.

The silver halide used in the photographic elements may be silver iodobromide, silver bromide, silver chloride, silver chlorobromide, silver chloroiodobromide, and the like. Preferably, the silver halide used in the photographic elements of the present invention may contain at least 90% silver chloride or more (for example, at least 95%, 98%, 99% or 100% silver chloride). In the case of such high chloride silver halide emulsions, some silver bromide may be present but typically substantially no silver iodide is present. Substantially no silver iodide means the iodide concentration would be no more than 1%; and preferably less than 0.5 or 0.1%. Additionally, the possibility is also contemplated that the silver chloride could be treated with a bromide source to increase its sensitivity, although the bulk concentration of bromide in the resulting emulsion will typically be no more than about 2 to 2.5% and preferably between about 0.6 to 1.2% (the remainder being silver chloride). In any event, regardless how silver bromide is present in the emulsion, it may for example be up to only 3% or even only 2%. All of the foregoing % figures are mole %.

The type of silver halide grains preferably include polymorphic, cubic, and octahedral. The grain size of the silver halide may have any distribution known to be useful in photographic compositions, and may be ether polydipersed or monodispersed.

Tabular grain silver halide emulsions may also be used. Tabular grains are those with two parallel major faces each clearly larger than any remaining grain face and tabular grain emulsions are those in which the tabular grains account for at least 30 percent, more typically at least 50 percent, preferably >70 percent and optimally >90 percent of total grain projected area. The tabular grains can account for substantially all (>97 percent) of total grain projected area. The tabular grain emulsions can be high aspect ratio tabular grain emulsions—i.e., ECD/t>8, where ECD is the diameter of a circle having an area equal to grain projected area and t is tabular grain thickness; intermediate aspect ratio tabular grain emulsions—i.e., ECD/t=5 to 8; or low aspect ratio tabular grain emulsions—i.e., ECD/t=2 to 5. The emulsions typically exhibit high tabularity (T), where T (i.e., $ECD/t^2$) >25 and ECD and t are both measured in micrometers (μm). The tabular grains can be of any thickness compatible with achieving an aim average aspect ratio and/or average tabularity of the tabular grain emulsion. Preferably the tabular grains satisfying projected area requirements are those having thicknesses of <0.3 μm, thin (<0.2 μm) tabular grains being specifically preferred and ultrathin (<0.07 μm) tabular grains being contemplated for maximum tabular grain performance enhancements. When the native blue absorption of iodohalide tabular grains is relied upon for blue speed, thicker tabular grains, typically up to 0.5 μm in thickness, are contemplated.

High iodide tabular grain emulsions are illustrated by House U.S. Pat. No. 4,490,458, Maskasky U.S. Pat. No. 4,459,353 and Yagi et al EPO 0 410 410.

Tabular grains formed of silver halide(s) that form a face centered cubic (rock salt type) crystal lattice structure can have either (100) or (111) major faces. Emulsions containing (111) major face tabular grains, including those with controlled grain dispersities, halide distributions, twin plane spacing, edge structures and grain dislocations as well as adsorbed {111} grain face stabilizers, are illustrated in those references cited in *Research Disclosure I,* Section I.B.(3) (page 503).

The silver halide grains to be used in the invention may be prepared according to methods known in the art, such as those described in *Research Disclosure I* and James, *The Theory of the Photographic Process.* These include methods such as ammoniacal emulsion making, neutral or acidic emulsion making, and others known in the art. These methods generally involve mixing a water soluble silver salt with a water soluble halide salt in the presence of a protective colloid, and controlling the temperature, pAg, pH values, etc, at suitable values during formation of the silver halide by precipitation.

The silver halide to be used in the invention may be advantageously subjected to chemical sensitization with noble metal (for example, gold) sensitizers, middle chalcogen (for example, sulfur) sensitizers, reduction sensitizers and others known in the art. Compounds and techniques useful for chemical sensitization of silver halide are known in the art and described in *Research Disclosure I* and the references cited therein.

The photographic elements of the present invention, as is typical, provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), gelatin derivatives (e.g., acetylated gelatin, phthalated gelatin, and the like), and others as described in *Research Disclosure I.* Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like, as described in *Research Disclosure I.* The vehicle can be present in the emulsion in any amount useful in photographic emulsions. The emulsion can also include any of the addenda known to be useful in photographic emulsions. These include chemical sensitizers, such as active gelatin, sulfur, selenium, tellurium, gold, platinum, palladium, iridium, osmium, rhenium, phosphorous, or combinations thereof. Chemical sensitization is generally carried out at pAg levels of from 5 to 10, pH levels of from 5 to 8, and temperatures of from 30° to 80° C., as described in *Research Disclosure I,* Section IV (pages 510–511) and the references cited therein.

The silver halide may be sensitized by sensitizing dyes of formula (I) for a blue sensitive emulsion, or other senstizing dyes, by any method known in the art, such as described in *Research Disclosure I.* Any of the dyes may be added to the emulsion of the silver halide grains which it is to sensitize, and a hydrophilic colloid at any time prior to (e.g., during or after chemical sensitization) or simultaneous with the coating of the emulsion on a photographic element. The dyes may, for example, be added as a solution in water or an alocohol. The dye/silver halide emulsion may be mixed with a dispersion of color image-forming coupler immediately before coating or in advance of coating (for example, 2 hours).

Photographic elements of the present invention are preferably imagewise exposed using any of the known techniques, including those described in *Research Disclosure I,* section XVI. This typically involves exposure to light in the visible region of the spectrum, and typically such exposure is of a live image through a lens, although exposure can also be exposure to a stored image (such as a computer stored image) by means of light emitting devices (such as light emitting diodes, CRT and the like).

Photographic elements comprising the composition of the invention can be processed in any of a number of well-known photographic processes utilizing any of a number of well-known processing compositions, described, for example, in *Research Disclosure I,* or in T. H. James, editor, *The Theory of the Photographic Process,* 4th Edition, Macmillan, New York, 1977. In the case of processing a negative working element, th element is treated with a color developer (that is one which will form the colored image dyes with the color couplers), and then with a oxidizer and a solvent to remove silver and silver halide. In the case of processing a reversal color element, the element is first treated with a black and white developer (that is, a developer which does not form colored dyes with the coupler compounds) followed by a treatment to fog silver halide (usually chemical fogging or light fogging), followed by treatment with a color developer. Preferred color developing agents are p-phenylenediamines. Especially preferred are:

4-amino N,N-diethylaniline hydrochloride, 4-amino-3-methyl-N,N-diethylaniline hydrochloride, 4-amino-3-methyl-N-ethyl-N-(β-(methanesulfonamido) ethylaniline sesquisulfate hydrate, 4-amino-3-methyl-N-ethyl-N-(β-hydroxyethyl)aniline sulfate, 4-amino-3-β-(methanesulfonamido)ethyl-N,N-diethylaniline hydrochloride and 4-amino-N-ethyl-N-(2-methoxyethyl)-m-toluidine di-p-toluene sulfonic acid.

Development is followed by bleach-fixing, to remove silver or silver halide, washing and drying.

The present invention will be further described in the examples below. The structures of comparison dyes C-1 through C-3 are as follows:

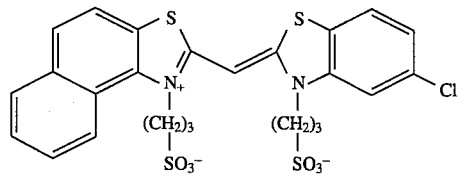

C-1

-continued

C-2

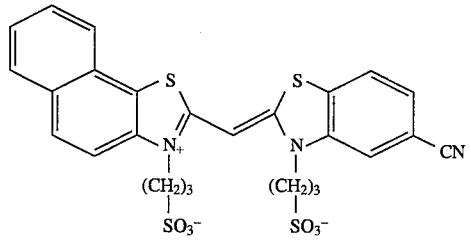

C-3

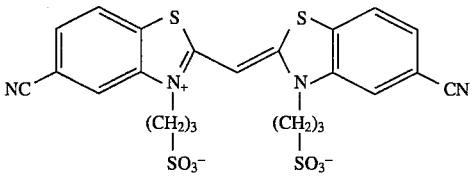

PHOTOGRAPHIC EVALUATION EXAMPLE 1

The dyes (Table II below) were coated on a polyester support in a Black and White format at a high ($3.8\times10^{-4}$ moles/Ag mole) and low ($1.9\times10^{-4}$ moles/Ag mole) dye level. The emulsions were aurous sulfide sensitized 0.39 Bm (cubic edge length) silver chloride cubic emulsions which were either pure silver chloride or had 1.0% bromide present. The coatings were given a 1/10" second exposure on a wedge spectrographic instrument covering a wavelength range from 350 to 750 nm. The instrument contains a tungsten light source and a step tablet ranging in density from 0 to 3 density units in 0.3 density steps. The exposed coatings were processed as described below. The photographic speed of the dyes is reported (Table II) in terms of a sensitizing ratio (SR), which is defined as the speed at kmax (in log E units multiplied by 100) minus the intrinsic speed of the dyed emulsion at 400 nm (in log E units multiplied by 100) plus 200. This measurement of speed allows for comparison while using a uniform chemical sensitization that is not optimized for each sensitizing dye. The λmax was determined from spectrophotometric measurements of the dyed coatings.

PROCESSING

Temperature: 68F.

| Chemical | Process Time |
|---|---|
| DK-50 developer | 6'00" |
| Stop Bath* | 15" |
| Fix** | 5'00" |
| Wash | 10'00" |

*composition is 128 mL acetic acid diluted to 8 L with distilled water.
**composition is 15.0 g sodium sulfite, 240.0 g sodium thiosulfate, 13.3 mL glacial acetic acid, 7.5 g boric acid, and 15.0 g potassium aluminum sulfate diluted to 1.0 L with distilled water.

TABLE II

| | | Photographic Performance | | | |
|---|---|---|---|---|---|
| | | SR Speed | | | |
| | | No Bromide | | 1% Bromide | |
| Dye | λmax (nm) | Low Dye | High Dye | Low Dye | High Dye |
| I-1 | 462 | 204 | 204 | 201 | 209 |
| I-5 | 475 | 164 | 179 | 174 | 199 |
| C-1 | 479 | — | 198 | — | 205 |

TABLE II-continued

| | | Photographic Performance | | | |
|---|---|---|---|---|---|
| | | SR Speed | | | |
| | | No Bromide | | 1% Bromide | |
| Dye | λmax (nm) | Low Dye | High Dye | Low Dye | High Dye |
| C-2 | 464 | 47 | 52 | 130 | 50 |

PHOTOGRAPHIC EVALUATION EXAMPLE 2

Coatings were made with the dyes listed in Table III, exposed and processed in the same manner as described in Example 1. The results are listed below.

TABLE III

| | | Photographic Performance | | | |
|---|---|---|---|---|---|
| | | SR Speed | | | |
| | | No Bromide | | 1% Bromide | |
| Dye | λmax (nm) | Low Dye | High Dye | Low Dye | High Dye |
| I-3 | 469 | 197 | 207 | 206 | 213 |
| I-4 | 467 | 206 | 215 | 208 | 215 |
| C-1 | 479 | — | 205 | — | 212 |

PHOTOGRAPHIC EVALUATION EXAMPLE 3

Coatings were made with the dyes listed in Table IV, exposed and processed in the same manner as described in Example 1. The results are listed below.

TABLE IV

| | | Photographic Performance | | | |
|---|---|---|---|---|---|
| | | SR Speed | | | |
| | | No Bromide | | 1% Bromide | |
| Dye | λmax (nm) | Low Dye | High Dye | Low Dye | High Dye |
| I-1 | 464 | 209 | 219 | 216 | 220 |
| C-3 | 436 | 51 | 54 | 136 | 151 |
| C-1 | 479 | — | 150 | — | 227 |

Tables II–IV indicate that the dyes of the invention give much shorter sensitization maximum than the comparison dye C-1 and give much higher photographic speed relative to comparison dyes C-2 and C-3.

PHOTOGRAPHIC EVALUATION EXAMPLE 4

The dyes (Table V below) were coated on a paper support at a level of $2.5\times10^{-4}$ moles/Ag on an aurous sulfide sensitized 0.78 micron silver chloride emulsion having the following coverages: silver (280 mg/m$^2$), gelatin (829 mg/m$^2$), 1-(3-acetamidophenyl)-5-mercaptotetrazole (68 mg/mole Ag). Potassium bromide, when present was at 741 mg/mole Ag. The yellow coupler dispersion contained N-(5-((4-(2,4-bis(1,1-dimethylpropyl)phenoxy)- 1-oxobutyl)amino)-2-chlorophenyl)- 4,4-dimethy-3-oxo-2-(4((4(phenylmethoxy)phenyl)sulfonyl)phenoxy)pentanamide coupler (1076 mg/m$^2$), and gelatin (829 mg/m$^2$).

The coupler dispersion was added to the dye/silver chloride emulsion immediately before coating. The elements also included a gelatin overcoat layer (1.08 g/m$^2$) and a gelatin undercoat layer (3.23 g/m$^2$). The layers were hardened with bis(vinylsulfonyl)methyl ether at 1.7% of the total gelatin weight.

To evaluate photographic sensitivity, the elements were exposed to a light source designed to simulate a color negative print exposure. The elements were then processed with RA-4 chemistry through a Colenta processor. This consists of a color development (45 sec, 35° C.), bleach-fix (45 sec, 35° C.) and stabilization or water wash (90 sec, 35° C.) followed by drying (60 sec, 60° C.). The speed at 1.0 density units above Dmin is listed in Table V.

| Color Developer | |
|---|---|
| Lithium salt of sulfonated polystyrene | 0.25 m |
| Triethanolamine | 11.0 mL |
| N,N-diethylhydroxylamine (85% by wt.) | 6.0 mL |
| Potassium sulfite (45% by wt.) | 0.5 mL |
| Color developing agent (4-(N-ethyl-N-2-methanesulfonylaminoethyl)-2-methyl-phenylenediaminesesquisulfatemonohydrate | 5.0 g |
| Stilbene compound stain reducing agent | 2.3 g |
| Lithium sulfate | 2.7 g |
| Potassium chloride | 2.3 g |
| Potassium bromide | 0.025 |
| Sequestering agent | 0.8 mL |
| Potassium carbonate | 25.0 g |
| Water to total of 1 liter, pH adjusted to 10.12 | |
| **Bleach-fix** | |
| Ammonium sulfite | 58 g |
| Sodium thiosulfate | 8.7 g |
| Ethylenediaminetetracetic acid ferric ammonium salt | 40 g |
| Acetic acid | 9.0 mL |
| Water to total 1 liter, pH adjusted to 6.2 | |
| **Stabilizer** | |
| Sodium citrate | 1 g |
| Water to total 1 liter, pH adjusted to 7.2 | |

TABLE V

| | | Speed (logE) | | Delta |
|---|---|---|---|---|
| Dye | λmax (nm) | Without Bromide | With Bromide | Speed |
| I-1 | 462 | 1.20 | 1.31 | 0.11 |
| C-1 | 478 | 1.18 | 1.66 | 0.48 |
| C-2 | 449 | 0.09 | 0.76 | 0.67 |

Table V indicates that, as expected, there is a speed loss for dyes that sensitize at wavelengths shorter than about 480 nm when a printer exposure is given because of the drop in printer intensity at shorter wavelengths. Table V also indicates that the invention dye shows less bromide sensitivity than the comparison dye.

It can be seen from Tables II–V that the dyes of the present invention offer sensitization shorter than 480 nm and excellent photographic performance.

The present invention also specifically contemplates multilayer photographic elements as described in *Research Disclosure,* February 1995, Item 37038 (pages 79–115). Paricularly contemplated is the use of any of sensitizing dyes of formula (I) (particularly each of I-1 through I-8), in each of the photographic elements described in detail in Sections XVII through XXII of that *Research Disclosure.*

The preceding examples are set forth to illustrate specific embodiments of this invention and are not intended to limit the scope of the compositions or materials of the invention.

It will be understood that variations and modifications can be effected within the spirit and scope of the invention.

We claim:

1. A photographic element comprising a silver halide emulsion having a maximum sensitivity in the visible region at less than 480 nm and being sensitized by a dye of formula (I):

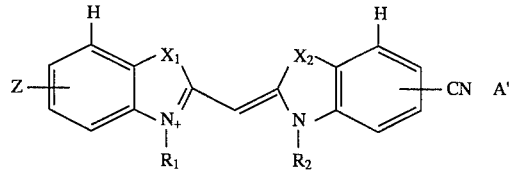

(I)

wherein: $X_1$ and $X_2$ each independently represent S, Se or O; $R_1$ and $R_2$ are, independently, an alkyl group; Z represents an aromatic group or heteroaromatic group that is directly appended to the benzene ring shown or is attached through a linking group provided that the atoms of the linking group are sp$^2$ hybridized, or Z can be a fused aromatic ring group; the benzene rings shown in formula (I) can be further substituted or not, and; A' is one or more ions as needed to balance the charge on the molecule.

2. A photographic element according to claim 1 wherein both $X_1$ and $X_2$ are not both O.

3. A photographic element according to claim 2 wherein at least one of $R_1$ or $R_2$ is substituted by an acid or acid salt group.

4. A photographic element according to claim 1 wherein the emulsions is sensitized to have a maximum sensitivity in the visible region at less than or equal to 475 nm.

5. A photographic element according to claim 1 wherein the emulsion is at least 90 mol % silver chloride.

6. A photographic element comprising a silver halide emulsion of at least 90 mol % silver chloride, having a maximum sensitivity in the visible region at less than or equal to 475 nm, and being sensitized by a dye of formula (Ia):

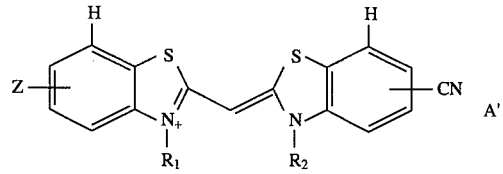

(Ia)

wherein: $R_1$ and $R_2$ are, independently, an alkyl group; Z represents an aromatic group or heteroaromatic group that is directly appended to the benzene ring shown; the benzene rings shown in formula (Ia) can be further substituted or not, and; A' is one or more ions as needed to balance the charge on the molecule.

7. A photographic element according to claim 6 wherein at least one of $R_1$ or $R_2$ is substituted by an acid or acid salt group.

8. A photographic element according to claim 7 wherein $R_1$ and $R_2$ are 1–8 carbon alkyl groups, and Z is a phenyl group, pyrrolo group, furyl group or thiophene group.

9. A photographic element according to claim 7 wherein $R_1$ and $R_2$ are 1–8 carbon alkyl groups, and Z is a pyrrolo group, furyl group or thiophene group.

10. A photographic element comprising a silver halide emulsion of at least 90 mol % silver chloride which has a maximum sensitivity in the visible region at less than or equal to 475 nm and which is sensitized by a dye of formula (Ib):

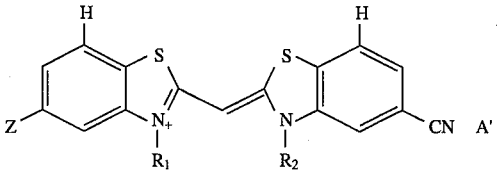

(Ib)

wherein: $R_1$ and $R_2$ are, independently, 1 to 8 carbon alkyl groups, at least one of which is substituted by an acid or acid salt; Z is a phenyl group, pyrrolo group, furyl group or thiophene group that is directly appended to the benzene ring shown, and; A' is one or more ions as needed to balance the charge on the molecule.

11. A photographic element according to claim 10 wherein the silver halide is at least 95 mol % silver chloride.

12. A photographic element according to claim 11 wherein the silver halide is up to 3 mol % silver bromide.

13. A photographic element according to claim 11 wherein the silver halide is at least 98 mol % silver chloride and contains up to 2 mol % silver bromide.

* * * * *

UNITED STATES PATENT AND TRADEMARK OFFICE

CERTIFICATE OF CORRECTION

PATENT NO. : 5,516,628

DATED : May 14, 1996

INVENTOR(S) : Parton et al

It is certified that error appears in the above-identified patent and that said Letters Patent is hereby corrected as shown below:

On the title page, item [75] Inventor, "Vishwakarma, L. Chand" should read --Lal Chand Vishwakarma--

Signed and Sealed this

Seventeenth Day of September, 1996

*Attest:*

*Attesting Officer*

BRUCE LEHMAN

*Commissioner of Patents and Trademarks*